US011425949B1

(12) United States Patent
Reek et al.

(10) Patent No.: US 11,425,949 B1
(45) Date of Patent: Aug. 30, 2022

(54) BALLOON HEADDRESS

(71) Applicants: Barrett Reek, Mercer Island, WA (US); Connie Reek, Mercer Island, WA (US)

(72) Inventors: Barrett Reek, Mercer Island, WA (US); Connie Reek, Mercer Island, WA (US)

( * ) Notice: Subject to any disclaimer, the term of this patent is extended or adjusted under 35 U.S.C. 154(b) by 0 days.

(21) Appl. No.: 17/407,929

(22) Filed: Aug. 20, 2021

(51) Int. Cl.
*A42B 1/24* (2021.01)
*A42B 1/004* (2021.01)
*A42B 1/203* (2021.01)

(52) U.S. Cl.
CPC ..... *A42B 1/24* (2013.01); *A42B 1/004* (2013.01); *A42B 1/203* (2013.01)

(58) Field of Classification Search
CPC ..... A42B 1/004; A42B 1/006; A42B 1/205; A42B 1/206; A42B 1/24; A42B 1/248; A42B 1/203; A42B 3/0406; A42B 1/242; A42B 1/244; A63H 2027/1008; A63H 2027/1041; A63H 27/10; A45B 11/04; A45D 8/40; A45D 8/006; A45D 8/36; A45D 8/004; A41D 20/00
USPC ..... 2/DIG. 11; 224/181; D2/871, 875; D28/41; 132/54, 274, 275
See application file for complete search history.

(56) References Cited

U.S. PATENT DOCUMENTS

D40,759 S * 7/1910 Prevear ..... A42B 1/004 D28/41
1,227,019 A 5/1917 Thompson
1,438,141 A * 12/1922 Schmidt ..... A45D 8/36 132/273
1,539,706 A * 5/1925 Wallman ..... A45D 8/36 132/273
D68,685 S * 11/1925 Weinrott et al. ..... A42B 1/004 D2/871
D70,296 S * 6/1926 Skaruda ..... A63H 27/10 D28/41
D144,151 S * 3/1946 Arpin ..... A45D 8/36 D2/875
2,840,948 A * 7/1958 Stickley ..... A63H 27/10 446/223
3,360,801 A * 1/1968 Parrilla ..... A42B 1/203 2/195.5
4,428,149 A 1/1984 Brown
4,473,225 A 9/1984 Miller
4,498,199 A 2/1985 Margolis
4,715,841 A 12/1987 Nelson
(Continued)

FOREIGN PATENT DOCUMENTS

CN 208711017 U 4/2019
FR 612568 A * 10/1926
GB 252296 A * 5/1926 ..... A63H 27/10

*Primary Examiner* — Amy Vanatta
(74) *Attorney, Agent, or Firm* — Timothy E. Siegel Patent Law, PLLC; Timothy E. Siegel

(57) ABSTRACT

A balloon headdress having a structure sized and shaped to fit on a human head, the structure defining an inside, facing the head when worn, and an outside, opposed to the inside. A plurality of engagement units is supported on the outside of the structure and a number of balloon retaining units are engaged to the engagement units and adapted to receive, support and direct an inflated balloon to extend in a predetermined direction relative to each balloon retaining unit.

16 Claims, 5 Drawing Sheets

(56) References Cited

U.S. PATENT DOCUMENTS

| | | | | | |
|---|---|---|---|---|---|
| 4,719,651 | A * | 1/1988 | Tereshinski | A42B 1/004 | 2/209.13 |
| 4,798,554 | A | 1/1989 | Nelson | | |
| 4,881,916 | A | 11/1989 | Houser | | |
| 4,919,381 | A | 4/1990 | Buist | | |
| 5,027,992 | A * | 7/1991 | Murray, III | G09F 21/02 | 224/181 |
| D336,543 | S * | 6/1993 | Murray, III | A45D 8/00 | D2/871 |
| 5,295,891 | A | 3/1994 | Schalk | | |
| 5,395,276 | A * | 3/1995 | Valentino | A63H 27/10 | 446/217 |
| 5,638,581 | A | 6/1997 | Burke | | |
| 6,024,102 | A * | 2/2000 | Huang | A45D 8/36 | 132/273 |
| 6,289,903 | B1 * | 9/2001 | Haufler | A45D 8/00 | 132/275 |
| 6,513,167 | B1 * | 2/2003 | Cheng | A45D 8/36 | 2/209.13 |
| 6,969,295 | B1 | 11/2005 | Sidwell | | |
| D537,984 | S * | 3/2007 | Steudle | A41G 3/0058 | D28/41 |
| D628,659 | S | 12/2010 | Burns | | |
| 9,316,364 | B2 | 4/2016 | Halliburton | | |
| 10,561,217 | B1 * | 2/2020 | Wang | F21V 23/001 | |
| 2008/0202548 | A1 * | 8/2008 | Fala | A45D 8/36 | 132/273 |
| 2011/0174326 | A1 * | 7/2011 | Kim | A41G 3/0058 | 132/54 |
| 2015/0360140 | A1 * | 12/2015 | Hillery | A63H 37/00 | 446/475 |

* cited by examiner

BALLOON HEADDRESS

BACKGROUND OF THE INVENTION

Balloons have been used to create engaging headgear, by tying a balloon or set of balloons into a shape that easily fits on a human head. But doing this requires some skill and training. Festooning a person's head, with a colorful assortment of balloons would add an element of festivity to any celebratory gathering, particularly a child's celebration.

SUMMARY OF INVENTION

The following embodiments and aspects thereof are described and illustrated in conjunction with systems, tools, and methods which are meant to be exemplary and illustrative, not limiting in scope. In various embodiments, one or more of the above-described problems have been reduced or eliminated, while other embodiments are directed to other improvements.

In a first separate aspect, the present invention may take the form of a balloon headdress having a structure sized and shaped to fit on a human head, the structure defining an inside, facing the head when worn, and an outside, opposed to the inside. A plurality of engagement units is supported on the outside of the structure and a number of balloon retaining units are engaged to the engagement units and adapted to receive, support and direct an inflated balloon to extend in a predetermined direction relative to each balloon retaining unit.

In a second separate aspect, the present invention may take the form of a method of creating a balloon-festooned headdress, that uses a display headdress, having a structure sized and shaped to fit on a human head, the structure defining an inside, facing the head when worn, and an outside, opposed to the inside. Also, a plurality of engagement units is supported on the outside of the structure and a number of balloon retaining units, are engaged to the engagement units and are adapted to receive, support and direct an inflated balloon to extend in a predetermined direction relative to each the balloon retaining unit. In the method, a balloon is inflated, and its open end is tied shut. A balloon retaining is disengaged from an engagement and the inflated balloon is engaged to the balloon retaining unit. Then, the balloon retaining unit is reengaged to the engagement unit. This process is continued with further balloons.

In a third separate aspect, the present invention may take the form of a display headdress, including a polymeric structure sized and shaped to fit on a human head, the structure defining an inside, facing the head when worn, and an outside, opposed to the inside. Also, six or more engagement units are supported on the outside of the polymeric structure and six or more display units are attached to the engagement units.

BRIEF DESCRIPTION OF DRAWINGS

Various embodiments of the invention are disclosed in the following detailed description and accompanying drawings.

DETAILED DESCRIPTION AND EMBODIMENTS

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

To assist the description of the scope and its components the coordinate terms "inside" and "outside" are used to describe the disclosed embodiments. The terms are used consistently with the description of the exemplary applications and are in reference to the head of a user. With respect to the headdress, the "inside" faces the head when worn, and the outside faces away from the head, when the headdress is worn as intended.

Figure 1:
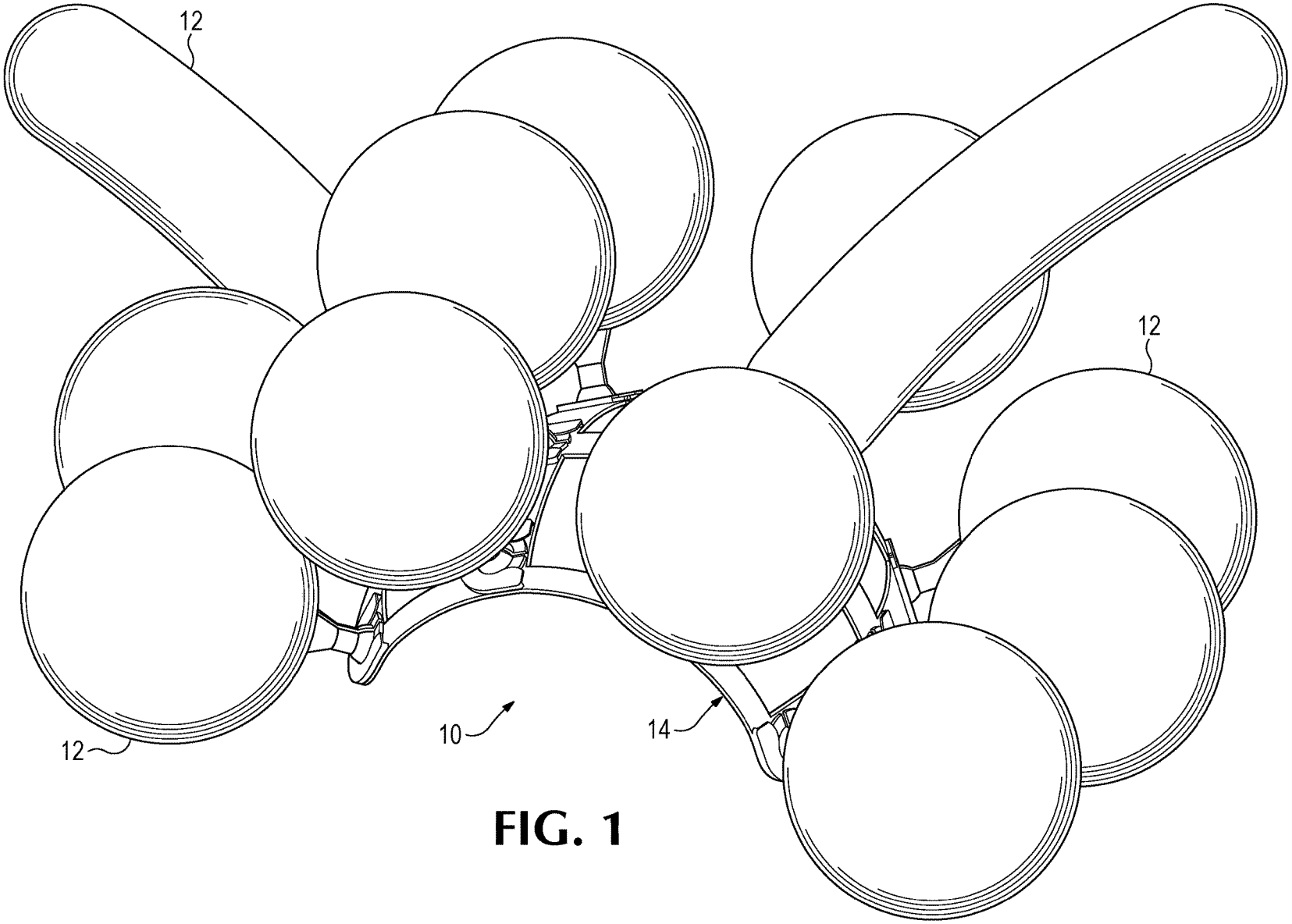
FIG. 1 is an isometric view of an article of balloon headdress, festooned with inflated balloons.
Figure 2:
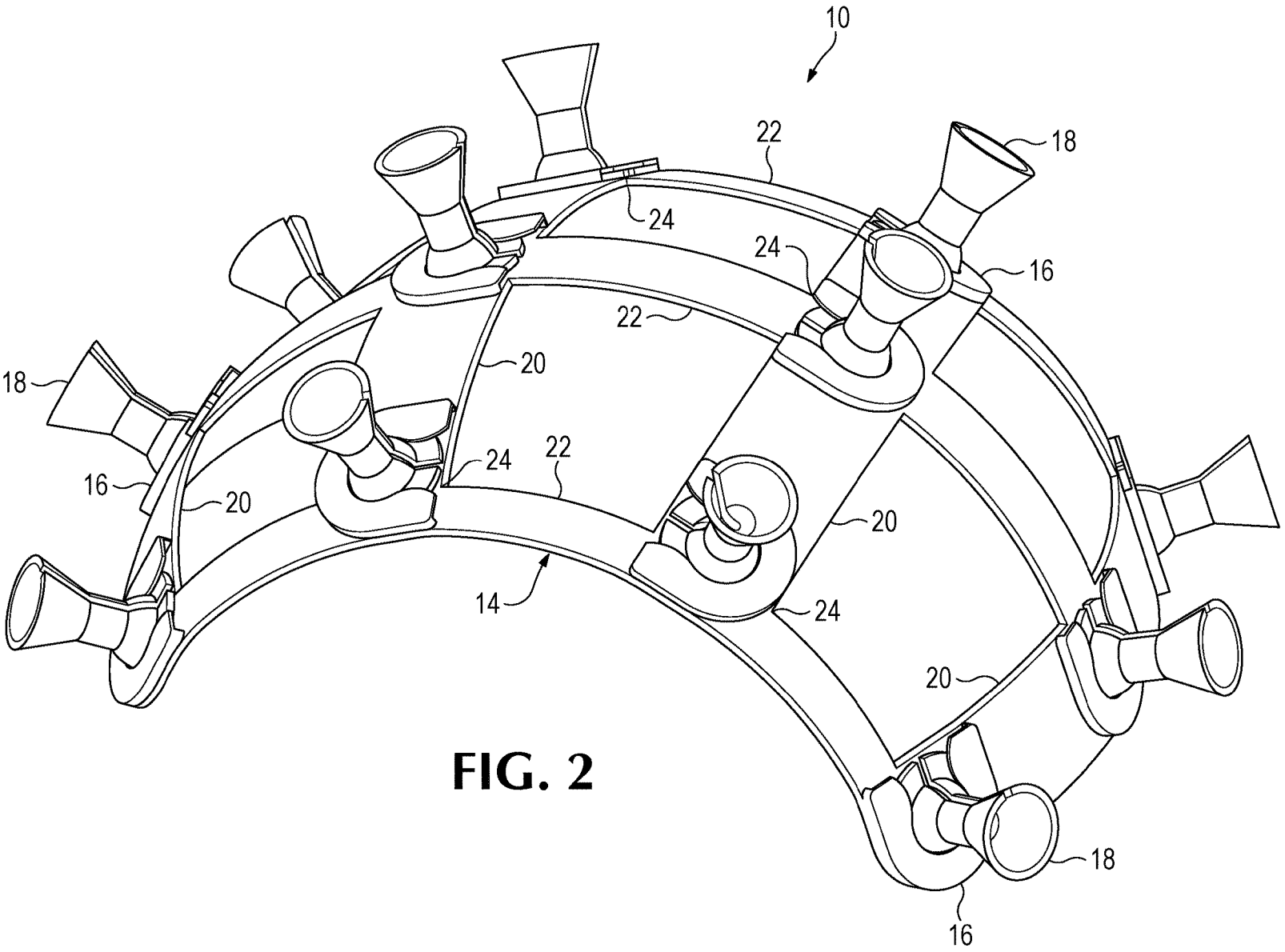
FIG. 2 is an isometric view of the headdress of FIG. 1, absent the balloons.

Referring to FIG. 1, a headdress 10 is shown having twelve inflated balloons 12 attached to it. Although the balloons are shown as being uniformly spheroidal in shape, in other instances of use, the balloons may be various shapes, creating a spectacular assemblage of differently colored shapes abutting one another. FIG. 2 shows headdress 10, having a structure 14, supporting on its outside a set of engagement units 16 and a set of balloon retaining units 18, each adapted to fit into an engagement unit 16. Structure 14 is a lattice of strips 20 and a cross-strips 22 hosting engagement units 16 at the intersections 24.

Figure 4:
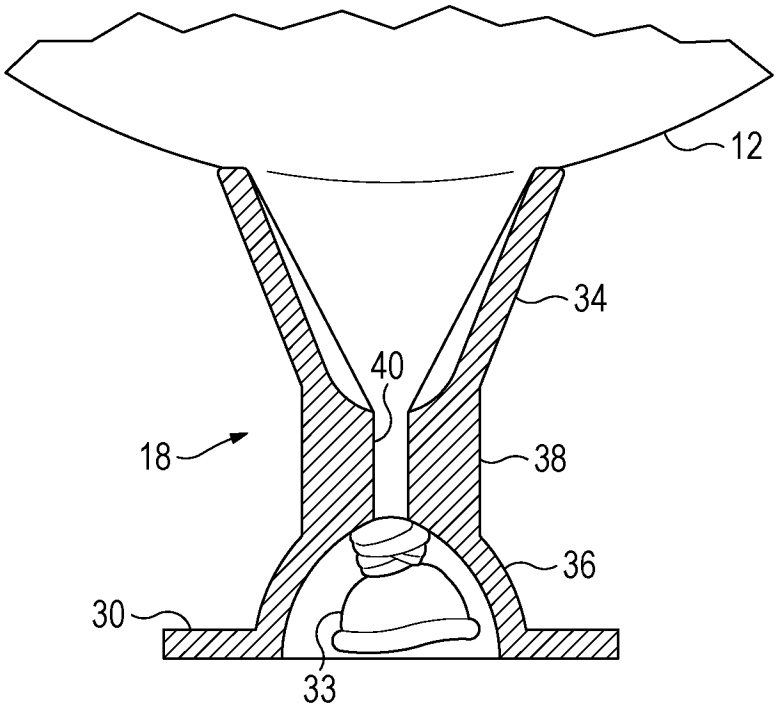
FIG. 4 is a sectional view of a balloon retaining unit, retaining an inflated balloon.
Figure 3:
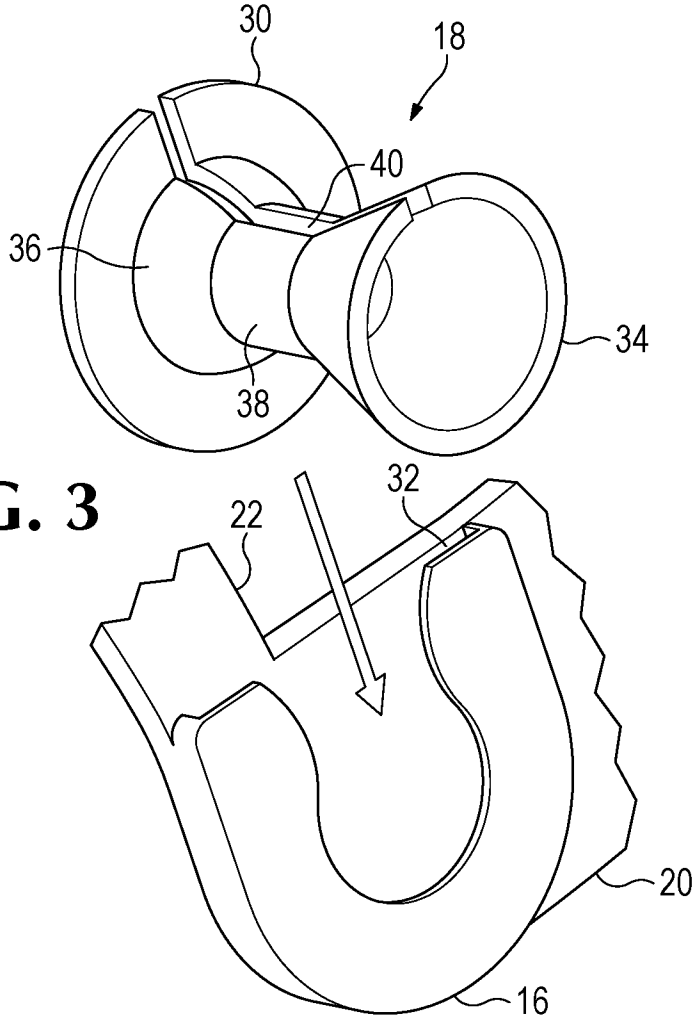
FIG. 3 is an isometric view of a balloon retaining unit, and an engagement unit.

Referring to FIGS. 3 and 4, an engagement unit 16 and a retaining unit 18, join together by a sliding motion as indicated by the arrow, whereby a retaining unit flange 30 is engaged with an engaging unit slot 32. Retaining unit 18, further includes an upper cup 34, a lower cup 36 and a septal wall 38, separating the cups 34 and 36. Wall 38 and cups 34 and 36 are cleft by a slot 40. A user may easily inflate a balloon 12, tie the end, slip the tied end 32 of the balloon through the slot so that the knot is in the lower cup 36, separated from the remainder of the balloon 12 by the septal all (and thereby retained). The upper cup 34, due in part to its expanding inner diameter, supports the balloon so that it will tend to extend outwardly in the specific direction in which upper cup 34 is pointing.

Figure 5:
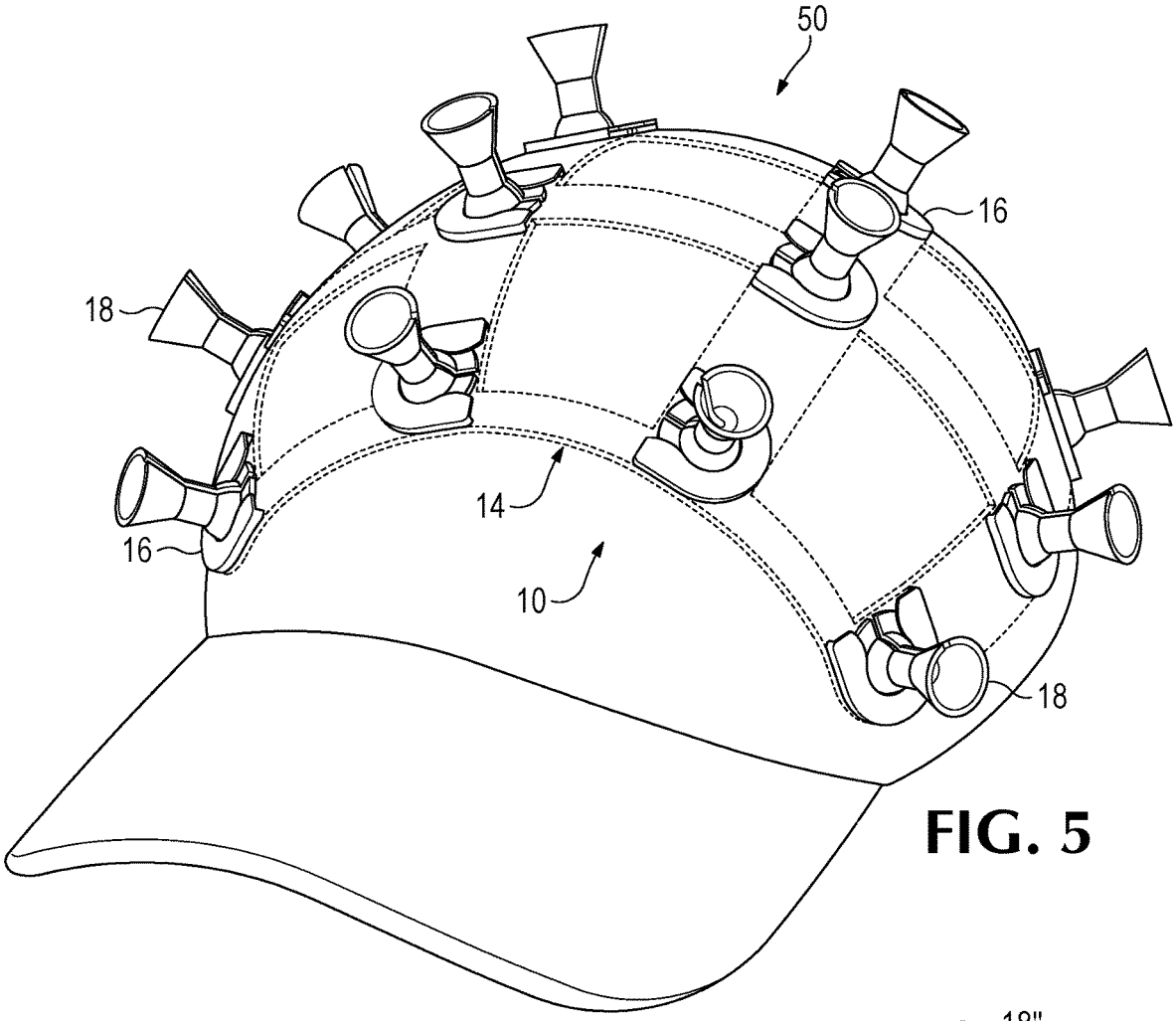
FIG. 5 is an isometric view of the headdress of FIG. 1, incorporated into a baseball cap.
Figure 6:
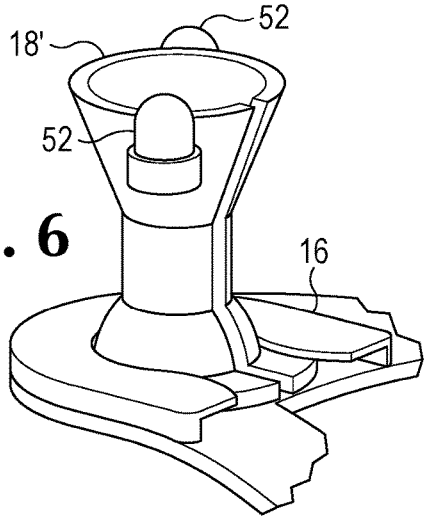
FIG. 6 is an isometric view of an illuminated balloon retaining unit
Figure 7:
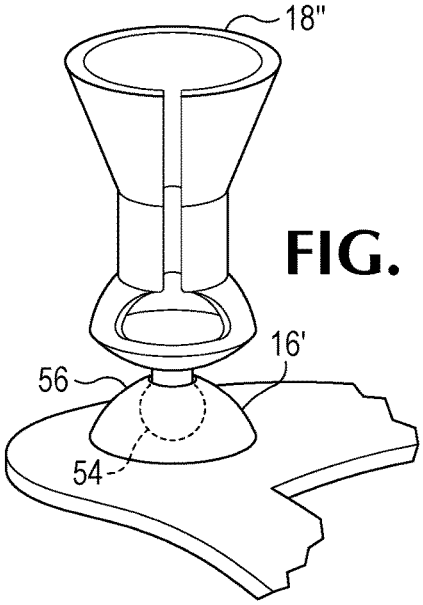
FIG. 7 is an isometric view of an alternative embodiment of a balloon retaining unit, engaged into an engagement unit.
Figure 8:
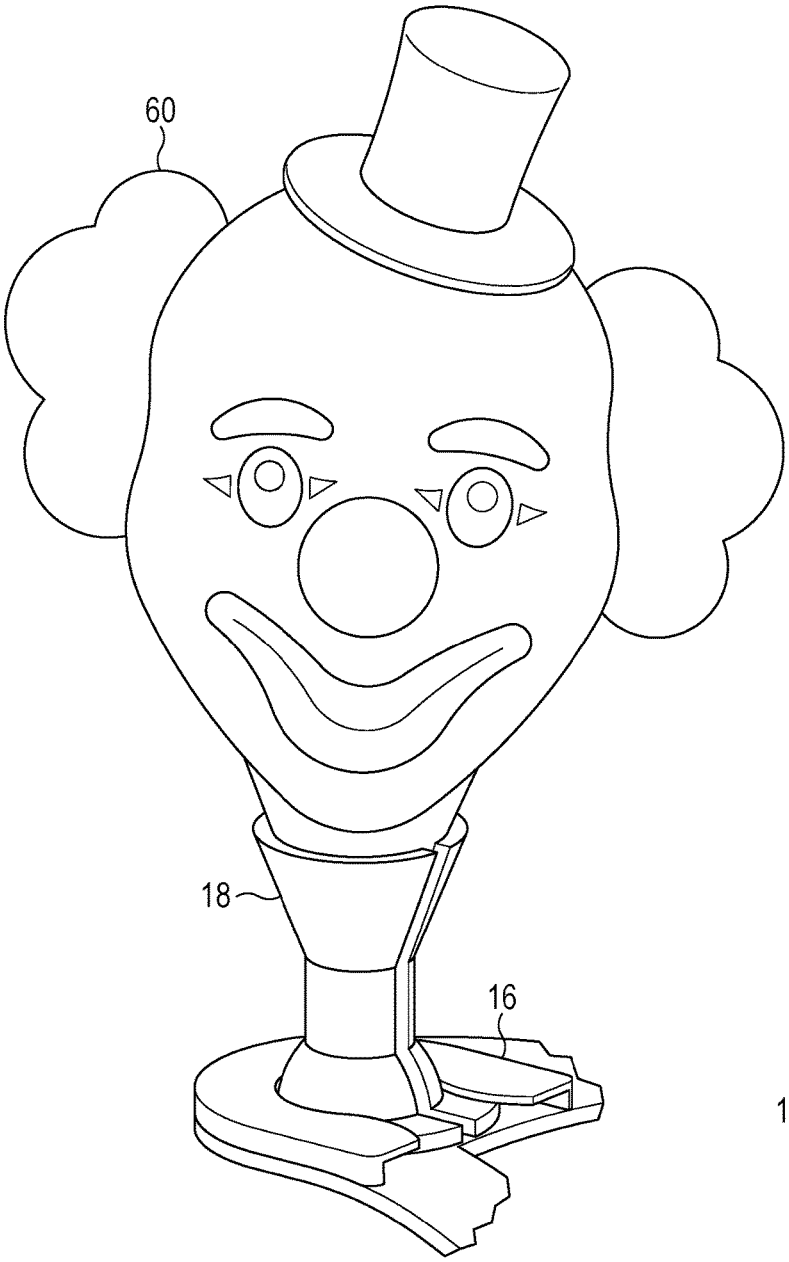
FIG. 8 is an isometric view of a clown face figurine engaged into an engagement unit.
Figure 9:
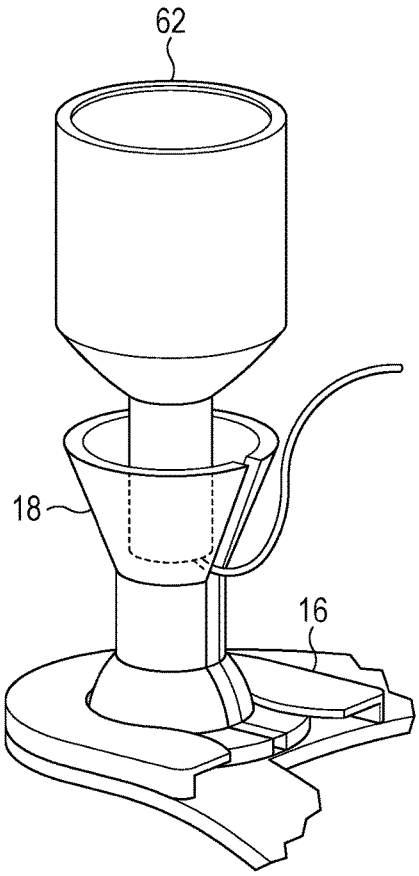
FIG. 9 is an isometric view of a confetti popper engaged into an engagement unit.

Referring to FIG. 5, in one embodiment the headdress 10 is incorporated into a baseball-cap style cap. All of the elements are the same, but the structure 12 has been sandwiched in between two pieces of fabric with the engagement units 16 extending outwardly through openings in the upper layer of fabric. Alternatively, headdress 10 can be worn over a baseball cap, with a team logo framed by the front portion of headdress 10. FIG. 6 shows an illuminated variant 18' of a retaining unit 18. A small battery (not shown) is secreted in an interior space of unit 18, with an electrical conductor connected to light emitting diodes 52. FIG. 7 shows a balloon retaining unit 18" and an engagement unit 16' that connect in a different way, with a ball 54 and a socket 56 that each have some resilient deformability, so that ball 54 will snap into socket 56 if pushed down into it, and can be pulled out, as well. FIG. 8 shows a clown face figurine 60, which in one embodiment is adapted to engage to retaining unit 18 (having a ball or knot that engages to lower cup 36 in the same manner as a balloon knot does). In another embodiment figurine 60 and retaining unit 18 are one unitary unit (that is they are sold joined together) and slide into engagement unit 16. FIG. 9 shows a confetti popper 62 engaged into a balloon retaining unit. In an alternative embodiment, the confetti popper is formed with a ball on a string, to retain it to lower cup 36.

In an alternative embodiment engagement unit and balloon retaining units are joined in some other manner, such as relying on the resilient deformability of a polymer ball, to permit it to pop into a socket.

In an alternative embodiment, one of more of the retaining units 18 are replaced with units that have a retaining flange 30 to engage with an engagement unit 16, but that have a preconfigured decorative item extending outwardly away from retaining flange 30 (and thereby the wearer's head), such as a flag-on-a-post, a figurine or confetti popping device.

The disclosed embodiments are illustrative, not restrictive. While specific configurations of the headdress have been described, it is understood that the present invention can be applied to a wide variety of display types. There are many alternative ways of implementing the invention.

What is claimed is:

1. A balloon headdress, comprising:

a) a structure sized and shaped to fit on a human head, said structure defining an inside, facing said head when worn, and an outside, opposed to said inside;

b) a plurality of engagement units, supported on said outside of said structure;

c) a number of balloon retaining units, engaged to said engagement units and adapted to receive, support and direct an inflated balloon to extend in a predetermined direction relative to each said balloon retaining unit; and d) wherein said structure extends along a three-dimensional curve, thereby defining a structure-extent at each engagement unit and, where said balloon retaining units are slidingly engaged, in a dimension generally parallel to said structure-extent at said engagement unit to said engagement units and can be disengaged by being slid out.

2. The balloon headdress of claim 1, wherein said balloon retaining units each include an upper cup and opposed lower cup, separated by a wall, and wherein a vertical slot is defined in said upper cup, lower cup and wall, whereby a tied balloon may be introduced, so that its knot is in said lower cup and a portion of balloon passes through said slot in said wall and is supported in said upper cup.

3. The balloon headdress of claim 1, being made of polymer.

4. The balloon headdress of claim 3, wherein said polymer is arranged in a set of strips, each strip hosting multiple engagement units.

5. The balloon headdress of claim 4, wherein said strips intersect and are joined with a set of cross-strips.

6. The balloon headdress of claim 4, having more than six engagement units, including at least two strips, each hosting at least three engagement units.

7. The balloon headdress of claim 4, having more than eight engagement units, including at least three strips, each hosting at least two engagement units.

8. The balloon headdress of claim 1, further including a hat, into which said structure is incorporated.

9. A method of creating a balloon-festooned headdress, comprising:

a) providing a display headdress, including:

i. a structure sized and shaped to fit on a human head, said structure defining an inside, facing said head when worn, and an outside, opposed to said inside;

ii. a plurality of engagement units, supported on said outside of said structure;

iii. a number of balloon retaining units, engaged to said engagement units and adapted to receive, support and direct an inflated balloon to extend in a predetermined direction relative to each said balloon retaining unit; and iv. wherein said structure extends along a three-dimensional curve, thereby defining a structure-extent at each engagement unit, said balloon retaining units are slidingly engaged, in a dimension generally parallel to said structure-extent at said engagement unit, to said engagement units and can be disengaged by being slid out;

b) inflating a balloon and tying its open end;

c) disengaging a balloon retaining unit from an engagement unit and engaging said balloon to said balloon retaining unit, and reengaging said balloon retaining unit to said engagement unit;

d) repeating steps b) and c) for additional balloons.

10. The method of claim 9, wherein said balloon retaining units each include an upper cup and opposed lower cup, separated by a wall, and wherein a vertical slot is defined in said upper cup, lower cup and wall, whereby a tied balloon may be introduced, so that its knot is in said lower cup and a portion of balloon passes through said slot in said wall and is supported in said upper cup.

11. The method of claim 9, wherein said headdress is made of polymer.

12. The method of claim 11, wherein said polymer is arranged in a set of strips, each strip hosting multiple engagement units.

13. The method of claim 12, wherein said strips intersect and are joined with a set of cross-strips.

14. The method of claim 12, wherein said display headdress has more than six engagement units, including at least two strips, each hosting at least three engagement units.

15. The method of claim 12, wherein said display headdress has more than eight engagement units, including at least three strips, each hosting at least two engagement units.

16. The method of claim 9, wherein said display headdress further includes a hat, into which said structure is incorporated.

* * * * *